United States Patent [19]

Kleiner et al.

[11] 4,439,329

[45] Mar. 27, 1984

[54] AQUEOUS BASED FIRE FIGHTING FOAM COMPOSITIONS CONTAINING HYDROCARBYL SULFIDE TERMINATED OLIGOMER STABILIZERS

[75] Inventors: Eduard K. Kleiner, Pound Ridge; Robert A. Falk, New City, both of N.Y.

[73] Assignee: Ciba-Geigy Corporation, Ardsley, N.Y.

[21] Appl. No.: 335,119

[22] Filed: Dec. 28, 1981

[51] Int. Cl.[3] ..... A62D 1/04; A62D 1/02; A62C 1/12

[52] U.S. Cl. ..... 252/8.05; 169/47; 252/3

[58] Field of Search ..... 169/46, 47; 252/3, 6.5, 252/8.05

[56] References Cited

U.S. PATENT DOCUMENTS

| | | | |
|---|---|---|---|
| 3,655,732 | 4/1972 | Rondestvedt | 260/486 H |
| 3,772,382 | 11/1973 | Dannals | 260/481 R |
| 3,839,405 | 10/1974 | Dannals | 260/465.4 |
| 4,069,244 | 1/1978 | Mueller | 546/301 |
| 4,081,399 | 3/1978 | Dear et al. | 252/356 |
| 4,089,804 | 5/1978 | Falk | 252/355 |
| 4,098,811 | 7/1978 | Falk | 260/459 A |
| 4,099,574 | 7/1978 | Cooper, et al. | 252/3 |
| 4,171,282 | 10/1979 | Mueller | 252/8.05 |

FOREIGN PATENT DOCUMENTS

| | | | |
|---|---|---|---|
| 19584 | 11/1980 | European Pat. Off. | 252/3 |
| 1245124 | 9/1971 | United Kingdom . | |

*Primary Examiner*—Leland A. Sebastian
*Assistant Examiner*—Howard J. Locker
*Attorney, Agent, or Firm*—Michael W. Glynn

[57] ABSTRACT

This invention relates to aqueous based fire fighting foams containing a stabilizing amount of an oligomer of the formula $$R_1—E—S(O)_n[M_1]_x[M_2]_y[M_3]_zH$$

wherein $R_1$ is an oleophilic aryl, araliphatic, aliphatic or cycloaliphatic group having up to 25 carbon atoms; E is a direct bond, or an organic covalently bonded divalent linking group, n is 0, 1 or 2, $[M_1]$ is a hydrophilic acrylamido monomer unit, $[M_2]$ is a copolymerizable non-acrylamido hydrophilic monomer unit, $[M_3]$ is a copolymerizable hydrophobic monomer unit, the average of the sum of x, y and z is between about 3 and about 500, and $x/x+y+z$ is between 1 and about 0.5. These stabilizing oligomer additives in aqueous based fire fighting foams improve foam expansion, foam drainage and fire extinguishing times.

21 Claims, No Drawings

AQUEOUS BASED FIRE FIGHTING FOAM COMPOSITIONS CONTAINING HYDROCARBYL SULFIDE TERMINATED OLIGOMER STABILIZERS

BACKGROUND OF THE INVENTION

The instant invention relates to sulfide terminated oligomers having a backbone of from 2 to 1000 units, in addition to those of the alkyl sulfide moiety, wherein the backbone of the oligomers are made up of hydrophilic acrylamide or substituted acrylamide monomer units or mixtures of such units and copolymerizable hydrophilic and hydrophobic monomer units, and the incorporation thereof into compositions for fire fighting foam, particularly protein hydrolysates.

Foaming agents are effective fire fighting systems for most hazard situations because foams provide great area and volume coverage, blanketing for cooling, sealing of the oxygen source from the fuel, and holding water in place for longer periods of time. To be most effective however, fire fighting foam systems must be stable, they must have a sufficiently high expansion ratio and they must have the ability to move and flow around obstacles.

The most commonly used fire fighting foams include protein foams, fluoroprotein foams, aqueous film forming foams (AFFF) including the special class of alcohol resistant AFFF, and finally synthetic detergent foams (Syndet).

The free radical telomerization of monomers has been recognized since the 1940's as a means of obtaining low molecular weight polymers. Chain transfer agents (telogens) are often added to polymerization recipes as molecular weight regulators to obtain compounds in a molecular weight range not otherwise easily accessible.

In 1946, B. F. Goodrich reported in U.S. Pat. No. 2,396,997 that sulfur containing modifiers, including dodecanethiol, are useful in polymerizing alkyl acrylates or styrene. U.S. Pat. No. 2,878,237 claimed that the molecular weight of acrylamide or acrylic aid could be controlled by mercapto dibasic acids.

Yamashita et al were the first to report the radical telomerization of acrylamide and thiol [Y. Yamashita, et al., Kogyo Kagaku Zasshi (Ind. Chem.), 62, 1274 (1959)]. Later he reported that dodecane thiol could also be used for the anionic telomerization of acrylamide or acrylonitrile [Yamashita, et al. Kogyo Kagaku Zasshi 63, 1746–1751 (1960)].

Subsequently Dannals of Uniroyal claimed the use of various alkyl sulfide telomers as emulsifiers during emulsion polymerization (U.S. Pat. No. 3,498,942), compositions comprised of sulfoxide and alkyl sulfone terminated telomers containing at least one carboxylic group (U.S. Pat. No. 3,668,230), or compositions of alkyl sulfide terminated telomers containing at least one carboxylic group (U.S. Pat. No. 3,839,405).

More recently Henkel has claimed the use of alkyl sulfide telomers of acrylamide (German Patent No. 2,558,591), or cotelomers of acrylonitrile and acrylic acid (German Patent No. 2,558,592), for use in soap compositions suitable for hard water. Alkyl sulfide terminated oligomers of both acrylamide or acrylic cotelomers were also claimed for use in heat exchangers to prevent corrosion and stone deposition (German Patent No. 2,730,645).

German Patent No. 2,745,201 by Arakawa Kagaku Kogyo claims the use of alkyl sulfide, alkyl sulfoxide, and alkylsulfo oligomers for aqueous dispersions of rosin-based materials in paper sizing agents. Finally, Yamada in 1979 [Yukagaku 28, (9) 605-10 (1979)] reports upon the calcium sequestering ability of acrylamide/acrylic acid telomers and suggests their use as sequestrants and metal enzyme models.

Copending U.S. application Ser. No. 129,872 filed Mar. 13, 1980, describes oligomeric fluorinated surfactants of the formula:

$$R_f\text{-E-S-}[M_1]_x[M_2]_yH$$

wherein $R_f$ is a straight or branched chain perfluoroalkyl of 4 to 18 carbon atoms and $M_1$ and $M_2$ represent hydrophilic and hydrophobic monomer units. These perfluoroalkyl sulfide terminated oligomers improve foam expansion, foam drainage and extinguishing times as well as reduce the flammability of hydrocarbon contaminated protein foams. Since they contain fluorochemicals they are inherently expensive.

DETAILED DESCRIPTION

The present invention pertains to aqueous based fire fighting foam compositions containing a stabilizing amount of an oleophilic hydrocarbyl sulfide terminated oligomer derived from oleophilic hydrocarbyl mercaptans and hydrophilic acrylamido monomer, and optionally further hydrophilic and/or hydrophobic monomers. Advantageously these oligomers are produced by way of free radical polymerization.

Generally, oligomers useful in stabilizing aqueous based fire fighting foams are those of those of the formula I:

$$R_1\text{-E-S(O)}_n[M_1]_x[M_2]_y[M_3]_zH \qquad \text{(I)}$$

wherein

- $R_1$ is an oleophilic aryl, araliphatic, aliphatic or cycloaliphatic group which is optionally substituted;
- E is a direct bond or an organic covalently bonded linking group;
- n is 0, 1 or 2;
- $[M_1]$ is a hydrophilic optionally substituted acrylamido monomer unit;
- $[M_2]$ is a copolymerizable non-acrylamido hydrophilic monomer unit;
- $[M_3]$ is a copolymerizable hydrophobic monomer unit;
- the average of the sum of x, y and z is between about 3 and about 500; and
- $x/x+y+z$ is between 1 and about 0.5.

It is understood that formula (I) is not intended to depict the exact sequence of the oligomer units, since the units $[M_1]$, $[M_2]$ and $[M_3]$ can be randomly distributed in the oligomer, or distributed as block oligomeric units in any order. The monomers, $M_1$, $M_2$ and $M_3$, from which the $[M_1]$, $[M_2]$ and $[M_3]$ units are derived, are known polymerizable monomers.

Suitable moieties when $R_1$ is an oleophilic aryl group include phenyl or naphthyl for example, which are unsubstituted or substituted by one or more substituents which are the same or different and include alkyl of up to 18 carbon atoms; alkoxy of up to 18 carbon atoms; chloro; bromo; acyl, eg. alkanoyl, of up to 18 carbon atoms; acyloxy, e.g. alkanoyloxy, of up to 18 carbon atoms; and acylamino, e.g. alkanoylamino of up to 18 carbon atoms.

Thus, representative oleophilic aryl groups include t-octylphenyl, nonylphenyl, phenyl, 3,5-di-(t-octyl)phenyl, p-tolyl, xylyl, p-propoxyphenyl, p-methoxyphenyl naphthyl, o-chloro-p-butylphenyl, p-stearylamidophenyl, p-stearylphenyl, p-butyrylphenyl and the like.

Suitable moieties when $R_1$ is an olephilic araliphatic group include aryl substituted alkyl or alkenyl of up to 12 carbon atoms wherein aryl is defined in the preceeding paragraph. Thus, representative oleophilic araliphatic groups include benzyl, phenethyl, styryl, p-octylbenzyl, methoxynaphthylmethyl, p-stearyloxybenzyl, and the like.

Suitable oleophilic groups include alkyl and alkenyl which are straight or branched chain and have up to 25 carbon atoms, and which are unsubstituted or substituted by one or more substituents which are the same or different and include hydroxy; alkoxy of up to 18 carbon atoms; chloro; bromo; acyl, e.g. alkanoyl, of up to 18 carbon atoms; acyloxy, e.g. alkanoloxy, of up to 18 carbon atoms; and acylamino, e.g. alkanoylamino of up to 18 carbon atoms.

Thus, representative oleophilic aliphatic groups include butyl, dodecyl, octadecyl, t-octyl, butoxypropyl, laurylamidoethyl, stearyloxypropyl, dodecenyl, butyryloxybutyl, and the like.

Suitable oleophilic cycloaliphatic groups include cycloalkyl of 5 to 7 carbon atoms, bicycloalkyl of 7 to 10 carbon atoms, cycloalkylalkylene of 6 to 12 carbon atoms and bicycloalkylalkylene of 8 to 14 carbon atoms, each of which are unsubstituted or substituted by alkyl of up to 18 carbon atoms, alkoxy of up to 18 carbon atoms, chloro, bromo, acyl, e.g. alkanoyl, or up to 18 carbon atoms; acyloxy, e.g. alkanoyloxy, of up to 18 carbon atoms, and acylamino, e.g. alkanoylamino, of up to 18 carbon atoms.

Thus, representative oleophilic cycloaliphatic groups include cyclohexyl, cyclopentyl, bicyclohexyl, 2,2,2-bicyclooctyl, bornyl, norbornyl, and the like.

Advantageously, $R_1$ contains a total of between 5 and 25 carbon atoms.

Preferably $R_1$ is straight or branched chain alkyl of 5 to 25 carbon atoms, most preferably 6 to 18 carbon atoms.

Suitable organic covalently bonded divalent linking groups E include carboxyalkylene, oxycarbonylalkylene, amidoalkylene, or carbonylaminoalkylene, where in each case alkylene has 1 to 6 carbon atoms; or is oxyalkylene or polyoxyalkylene of 1 to about 10 units, where in each case alkylene has 2 to 4 carbon atoms, preferably 2 to 3 carbon atoms, or said alkylene is substituted by hydroxyl.

Preferably E is a direct bond.

Suitable hydrophilic acrylamido monomer units, $[M_1]$, include those within the scope of the formula II

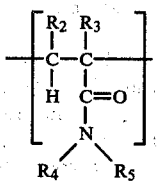

(II)

wherein $R_2$ and $R_3$ are independently hydrogen, chloro or bromo, or one of $R_2$ and $R_3$ is alkyl of 1 to 4 carbon atoms, alkoxy of 1 to 4 carbon atoms or alkanoylamido of 2 to 4 carbon atoms and the other is hydrogen;

and each of $R_4$ and $R_5$ independently represent hydrogen, alkyl of 1 to 18 carbon atoms which is unsubstituted or substituted by hydroxy, alkoxy of 1 to 4 carbon atoms, alkanoyl of 1 to 4 carbon atoms; alkanoyloxy of 1 to 4 carbon atoms; alkanoylamino of 1 to 4 carbon atoms; cyano; carboxy; ureido; alkylureido or dialkylureido wherein the alkyl group in each case contains 1 to 4 carbon atoms; amido; N-alkylamido or N,N-dialkylamido wherein the alkyl group in each case contains 1 to 4 carbon atoms; allyloxy; bromo; chloro; amino; N-alkylamino, N,N-dialkylamino or N,N,N-trialkylamino halide wherein the alkyl group in each case contains 1 to 4 carbon atoms; N-carboxyalkylamino, N-(carboxyalkyl)-N-alkylamino or N-(carboxyalkyl)-N,N-dialkylamino wherein the alkyl group in each case contains 1 to 4 carbon atoms; mercapto; alkylthio of 1 to 4 carbon atoms; morpholino; phenyl; or tolyl or is phenyl or phenyl substituted by carboxy, chloro, nitro, sulfo, alkyl of 1 to 4 carbon atoms or alkoxy of 1 to 4 carbon atoms; or is allyl, amino, naphthyl, cycloalkyl of 6 to 12 carbon atoms, phenylamino, N-alkylamino, N,N-dialkylamino or N,N,N-trialkylamino halide where in each case the alkyl group has 1 to 4 carbon atoms; or $R_4$ and $R_5$ taken together with the nitrogen to which they are attached represent morpholino, aziridino, piperidino or pyrrolidino;

with the proviso that the sum total of carbon atoms in $R_2$, $R_3$, $R_4$ and $R_5$ together contain no more than 10 carbon atoms.

Those moieties of formula II as defined above but wherein the sum total of carbon atoms in $R_2$, $R_3$, $R_4$ and $R_5$ together contain more than 10 carbon atoms are generally insufficiently hydrophilic to qualify as $[M_1]$ moieties, but are sufficiently hydrophobic as to qualify as $[M_3]$ moieties.

As the artisan can appreciate, the $[M_1]$ moieties may be the same or different. Thus, blends of eligible hydrophilic acrylamido monomer units may be advantageously used.

Preferably, $[M_1]$ is that of formula II wherein $R_2$ is hydrogen, $R_3$ is hydrogen or methyl, $R_4$ is hydrogen and $R_5$ is hydrogen or methyl, $R_4$ is hydrogen and $R_5$ is hydrogen or alkyl of up to 8 carbon atoms which is straight or branched chain, and is unsubstituted or substituted by hydroxy or acetyl, or mixtures thereof.

More preferably, $[M_1]$ is that of formula II wherein $R_2$ is hydrogen, $R_3$ is hydrogen, $R_4$ is hydrogen and $R_5$ is hydrogen or straight or branched chain alkyl of up to 4 carbon atoms.

Most preferably, $R_2$, $R_3$, $R_4$ and $R_5$ are hydrogen.

Examples of suitable hydrophilic acrylamido groups, $[M_1]$, include acrylamide, N-methylacrylamide, methacrylamide, N,N-dimethylacrylamide, N-methylolacrylamide, N-isopropylacrylamide, N-butylacrylamide, N-cyclohexylacrylamide, N-phenylacrylamide, N-benzylacrylamide, p-methylbenzyl-acrylamide, 1-acrylpyrrolidide, N,N-di-n-butylacrylamide, N-methyl-N-phenylacrylamide, N-2-hydroxyethylacrylamide, acrylyl-d,l-alanine, N-2-cyanoethylacrylamide, N-(2-diethylaminoethyl)acrylamide, N-ethoxymethylacrylamide, N-allyloxymethylacrylamide, N-(1-methyl-2-oxopropyl)acrylamide, N-[1,1,1-tris-(hydroxymethyl)-methyl]acrylamide, N-(2-morpholinoethyl)acrylamide, N-hydroxyethyl-N-methylacrylamide, N-allylacrylamide, N-methylmethacrylamide, n-octylmethacrylamide, 2-chloroacrylamide, 3-chloroacrylamide, N,N-diethyl-2-bromo-3-chloroacrylamide, 2-ethoxyacrylamide, 3-methoxyacrylamide, N-(n-butyl)-2-ethoxyacrylamide, (3-acrylamidopropyl)-N,N-dimethyl aminopropionate betaine, methacrylaziridide, methacrylpyrollidide, methacryl-d,l-alanine, N-(chloromethyl)-acrylamide, trimethylhydrazinium chloride, crotonamide, N-allylcrotonamide, and N,N-di-isopropyl crotonamide.

Suitable copolymerizable non-acrylamido hydrophilic monomer units, $[M_2]$, include those of the formula III

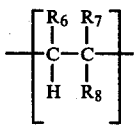

(III)

wherein $R_6$ is hydrogen, carboxy, —$COOR_9$ or alkyl of 1 to 4 carbon atoms which is unsubstituted or substituted by carboxy or hydroxy;

$R_7$ is hydrogen or alkyl of 1 to 4 carbon atoms; and $R_8$ is carboxy, carboxyalkyl of 2 to 5 carbon atoms, carboxyphenyl, a 5 to 6 membered nitrogeneous heterocyclic moeity, hydroxyalkyl of 1 to 4 carbon atoms, sulfophenyl, sulfo, —$COOR_9$, —$SO_2NR_{10}R_{10}$, —$NHCOR_9$,—$COR_9$, —$SO_2R_9$, —$OR_{10}$, —$OCOR_9$ or

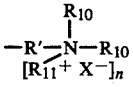

wherein $R_9$ is alkyl of 2 to 6 carbon atoms substituted by sulfo, carboxy, hydroxy, methoxy, or $R_{12}(OCH_2CH_2)_mO$— where $R_{12}$ is hydrogen or alkyl of 1 to 4 carbon atoms and m is 1 to 20;

$R_{10}$ is hydrogen, or lower alkyl of 1 to 5 carbon atoms which is substituted by sulfo, carboxy, hydroxy, methoxy or $R_{12}(OCH_2CH_2)_mO$— where $R_{12}$ *and m are as defined above*;

R′ is a direct bond, alkylene of 1 to 6 carbon atoms or phenylene;

$R_{11}$ is lower alkyl of 1 to 4 carbon atoms, phenyl or benzyl;

X is halo; and n is 0 or 1.

As the artisan can appreciate, sulfo and carboxy groups may be in the form of their free acids or in the form of their alkali, alkaline earth, ammonium or amine salts thereof.

Suitable 5 to 6 membered nitrogeneous heterocyclic moieties include those wherein $R_8$ represents a pyrrole, succinimide, pyrrolidone, imidazole, indole, pyrazoline, hydantoin, oxazolidone, pyridine, morpholine, oxazole, piperazine, pyrimidine, thiazole and pyrrolidine for example, as well as the quaternary ammonium derivatives, such as the N-$C_1$-$C_4$ alkyl halide quaternary salts, of the morpholine, pyridine and piperazine moieties.

The $[M_2]$ moieties may be the same or different. Thus, blends of eligible copolymerizable non-acrylamido hydrophilic monomer units may be advantageously employed.

Preferably, $[M_2]$ is that of formula III wherein $R_6$ is hydrogen, carboxy or —$COOR_9$ wherein $R_9$ is alkylene of 2 to 4 carbon atoms substituted by hydroxy or $R_{12}(OCH_2CH_2)_mO$— where $R_{12}$ is hydrogen, methyl or ethyl and m is 1 to 10; $R_7$ is hydrogen; and $R_8$ is carboxy; hydroxy; methoxy; alkoxy of 2 to 4 carbon atoms substituted by hydroxy or $R_{12}(OCH_2CH_2)_mO$— where $R_{12}$ is hydrogen, methyl or ethyl and m is 1 to 10; or —$COOR_9$ where $R_9$ is alkylene of 2 to 4 carbon atoms substituted by hydroxy or $R_{12}(OCH_2CH_2)_mO$— wherein $R_{12}$ is hydrogen, methyl or ethyl and m is 1 to 10.

Most preferably $[M_2]$ is that of formula III, wherein $R_7$ is hydrogen and $R_6$ and $R_8$ are independently —$COOR_9$ wherein $R_9$ is alkylene of 2 to 4 carbon atoms substituted by hydroxy or $H(OCH_2CH_2)_mO$—; or where $R_6$ and $R_7$ are hydrogen and $R_8$ is —$COOR_9$ where $R_9$ is alkylene of 2 to 4 carbon atoms substituted by hydroxy or $H(OCH_2CH_2)_mO$—; or where $R_6$ and $R_7$ are hydrogen and $R_8$ is methoxy or alkoxy of 2 to 4 carbon atoms substituted by hydroxy or $H(OCH_2CH_2)_mO$—; where in each case m is 1 to 10.

Hydrophilic monomers of the type $M_2$ which contain at least one hydrophilic group are known per se and many are commercially available, such as acrylic and methacrylic acid and salts thereof as well as derivatives such as their hydroxyalkyl esters, e.g. 2-hydroxyethyl, 3-hydroxypropyl, 2-hydroxypropyl or 2,3-hydroxypropyl esters; also ethoxylated and polyethoxylated hydroxyalkyl esters, such as esters of alcohols of the formula $$HO—C_mH_{2m}—O—(CH_2—CH_2—O)_n—R_{12}$$

wherein $R_{12}$ represents hydrogen or methyl, m represents 2 to 5 and n represents 1 to 20 or, esters of analogous alcohols wherein a part of the ethyleneoxide units is replaced by propyleneoxide units. Further suitable esters are dialkylaminoalkyl acrylates and methacrylates, such as the 2-(dimethyl-amino)-ethyl-, 2-(diethylamino)-ethyl- and 3-(dimethylamino)-2-hydroxypropyl esters. Further hydrophilic groups of interest are mono-olefinic sulfonic acids and their salts, such as sodium ethylene sulfonate, and sodium styrene sulfonate, and mono-olefinic derivatives of heterocyclic nitrogen-containing monomers, such as N-vinyl-pyrrole, N-vinyl-succinimide, 1-vinyl-2-pyrrolidone, 1-vinyl-imidazole, 1-vinyl-indole, 2-vinyl-imidazole, 4 (5) vinyl-imidazole, 2-vinyl-1-methoxy-imidazole, 5-vinyl-pyrazoline, 3-methyl-5-isopropenyl, 5-methylene-hydantoin, 3-vinyl-2-oxazolidone, 3-methacrylyl-2-oxazolidone, 3-methacrylyl-5-me-2-oxazolidone, 3-vinyl-5-methyl-2-oxazolidone, 2- and 4-vinyl-pyridine, 5-vinyl-2-methyl-pyridine, 2-vinyl-pyridine-1-oxide, 3-isopropenyl-pyridine, 2- and 4-vinyl-piperidine, 2- and 4-vinyl-quinoline, 2, 4-dimethyl-6-vinyl-s-triazine, 4-acrylylmorpholine as well as the quaternized derivatives of the above pyridines.

The above listed hydrophilic monomers of type $M_2$ can be used alone or in combination with each other as well as in combination with suitable hydrophobic monomers of type $M_3$.

Hydrophilic monomers of type $M_2$ which require a comonomer of the type $M_2$ or $M_3$ for polymerization are maleates, fumarates and vinylethers; the following monomer combinations are, for instance, useful: di(hydroxyalkyl) maleates, such as di(2-hydroxyethyl)maleate, and ethoxylated hydroxyalkyl maleates, hydroxyalkyl monomaleates, such as 2-hydroxyethyl monomaleate and hydroxylated hydroxyalkyl monomaleate with vinyl ethers, vinyl esters, styrene or generally any monomer which will easily copolymerize with maleates or fumarates; hydroxyalkyl vinyl ethers, such as 2-hydroxyethyl vinyl ether, 4-hydroxybutyl vinyl ether, with maleates, fumarates, or generally all monomers which will easily copolymerize with vinyl ethers.

Especially valuable hydrophilic monomers of type $M_2$ are acrylic acid, methacrylic acid and hydroxyethyl methacrylate.

Suitable hydrophobic copolymerizable monomer units, $[M_3]$, include those of formula II wherein the sum total of carbon atoms in $R_2$, $R_3$, $R_4$ and $R_5$ together contain a total of more than 10 carbon atoms or are of the formula IV

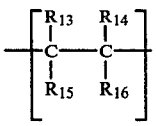

(IV)

wherein $R_{13}$ and $R_{14}$ are independently hydrogen, chloro, bromo, fluoro, or alkyl of 1 to 4 carbon atoms; $R_{15}$ is hydrogen, chloro, bromo, fluoro, alkyl of 1 to 8 carbon atoms, or —$COOR_{17}$; and $R_{16}$ is hydrogen, chloro, bromo, fluoro, alkenyl of 2 to 18 carbon atoms, alkyl of 1 to 18 carbon atoms, cyano, phenyl, phenyl substituted by alkyl of 1 to 4 carbon atoms or chloro, —$COOR_{17}$, —$SO_2NR_{17}R_{17}$ —$NHCOR_{17}$, —$COR_{17}$, —$SO_2R_{17}$, —$OR_{17}$ or —$OCOR_{17}$ wherein $R_{17}$ is alkyl of 1 to 18 carbon atoms which is unsubstituted or substituted by chloro, bromo or phenyl, or alkenyl of 2 to 18 carbon atoms which is unsubstituted or substituted by chloro, bromo or phenyl.

Preferably $R_{13}$ and $R_{14}$ are hydrogen, chloro, or bromo, $R_{15}$ is hydrogen, cyano, phenyl, —$COOR_{17}$, —$OR_{17}$ or —$OCOR_{17}$ where $R_{17}$ is alkyl of 1 to 18 carbon atoms.

Most preferably, $R_{13}$ and $R_{14}$ are hydrogen, $R_{15}$ is hydrogen or —$COOR_{17}$ and $R_{16}$ is hydrogen, cyano, phenyl, —$OR_{17}$, —$COOR_{17}$ or —$OCOR_{17}$ where $R_{17}$ is alkyl of 1 to 6 carbon atoms.

Hydrophobic monomers of the type $M_3$ which copolymerize with hydrophilic monomers of type $M_1$ and $M_2$ are known per se and include acrylates, methacrylates, maleates, fumarates and itaconates with one or more carbon atoms in the ester group, such as methyl, ethyl, propyl, isopropyl, butyl, hexyl, octyl, decyl, dodecyl, 2-ethylhexyl, octadecyl, cyclohexyl, phenyl, benzyl and 2-ethoxyethyl; vinyl esters with 1 to 18 carbons in the ester group, such as vinyl acetate, butyrate, laurate, stearate, 2-ethyl-hexanoate and benzoate; vinyl chloroacetate and isopropenyl acetate, vinyl carbonate derivatives; styrene and substituted styrenes such as o- and p-methyl, 3,4-dimethyl, 3,4-diethyl and p-chlorostyrene; alpha olefins which include substituted alpha olefins both straight and branched with up to 18 carbon atoms in the side chain including ethylene, propylene and butylene; methyl vinyl ether, isopropyl vinyl ether, isobutyl vinyl ether, 2-methoxyethyl vinyl ether, n-propyl vinyl ether, t-butyl vinyl ether, isoamyl vinyl ether, n-hexyl vinyl ether, 2-ethylbutyl vinyl ether, diisopropylmethyl vinyl ether, 1-methylheptyl vinyl ether, n-decylvinyl ether, n-tetradecyl vinyl ether, and n-octadecyl vinyl ether; vinyl chloride, vinylidene chloride, vinyl fluoride, vinylidene fluoride, acrylonitrile, methacrylonitrile, tetrafluoroethylene, trifluorochloroethylene, hexafluoropropylene; and dienes, particularly 1,3-butadiene, isoprene, and chloroprene, 2-fluorobutadiene, 1,1,3-trifluorobutadiene, 1,1,2,3-tetrafluorobutadiene, 1,1,2-trifluoro-3,4-dichlorobutadiene and tri- and pentafluorobutadiene and isoprene.

Most preferred are those oligomers of formula I wherein $[M_1]$ is that of formula II where $R_2$, $R_3$, $R_4$ and $R_5$ are hydrogen, n, y and z are each 0, and x is between about 3 and 50, E is direct bond and $R_1$ is alkyl of 6 to 18 carbon atoms.

The foam stabilizing oligomers of formula I useful in the instant invention are either known, per se, or can be advantageously prepared by known methods.

Thus, the instant stabilizing oligomers are prepared, for example, by reacting a mercaptan of formula V.

$$R_1—E—SH \quad (V)$$

wherein $R_1$ and E are as defined above, under polymerization conditions with a monomer of type $M_1$, optionally in the further presence of monomers of the type $M_2$ and/or $M_3$.

Preferably the mercaptan of formula V is reacted under free radical polymerization conditions with a hydrophilic monomer $M_1$ of the formula VI

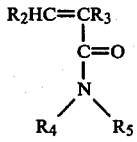

(VI)

wherein $R_2$, $R_3$, $R_4$ and $R_5$ are as defined above, optionally in the presence of a copolymerizable hydrophilic non-acrylamido monomer $M_2$ of the formula VII $$R_6HC=CR_7R_8 \quad (VII)$$

wherein $R_6$, $R_7$ and $R_8$ are as defined above, and/or a copolymerizable hydrophobic monomer $M_3$ of the formula VIII $$R_{13}R_{15}C=CR_{14}R_{16} \quad (VIII)$$

wherein $R_{13}$, $R_{14}$, $R_{15}$ and $R_{16}$ are as defined above, and optionally oxidizing the resulting oligomer of the formula IX $$R_1—E—S—[M_1]_x[M_2]_y[M_3]_zH \quad (IX)$$

wherein x, y and z are as defined above, to obtain the oligomer of formula I.

It is well known to the artisan that mercaptans act as so-called chain transfer agents in free-radical polymerization and copolymerization reaction. The previously listed hydrophilic monomers of type $M_1$ which contain at least one amide function, of type $M_2$ and hydrophobic monomers of type $M_3$ will either homopolymerize and/or copolymerize in the presence of a free-radical initiator and therefore readily react with mercaptans forming the instant oligomers of type I in high yield.

The polymerization reaction is performed in an essentially water free reaction medium, preferably in a lower alcohol such as methanol or isopropanol, or acetone or a lower alkyl cellosolve which dissolve the reactants, and catalyst.

Generally the oligomerization temperature is maintained at a temperature between 20° and 60° C., but temperatures up to 100° C. may be used as well. Optimum temperature may be readily determined for each oligomerization and will depend on the reaction, the relative reactivity of the monomers and the specific free-radical initiators used. In order to facilitate the free-radical propagation necessary for an effective catalyst reaction an oxygen-free atmosphere is desirable and the oligomerizations are carried out under nitrogen.

The catalyst employed is advantageously a free-radical initiator, such as the peroxides, persulfates or azo compounds. These materials are well known in the art. However, particularly efficacious results are obtained using organic peroxides and hydroperoxides, hydrogen peroxides, azo catalysts and water soluble persulfates. Specific examples include ammonium persulfate, lauroyl peroxide, tert butyl peroxide and particularly the azo catalysts 2,2'-azobis(isobutyronitrile); 2,2'-azobis-(2,4-dimethylvaleronitrile); 2-tert-butylazo-2-cyanopropane; 1-tert-butylazo-1-cyanocyclohexane; and 2,2'azobis(2,4-dimethyl-4-methoxyvaleronitrile).

Catalytic amounts of initiator are used, that is between 0.01 and 0.5% by weight of monomers depending on the particular initiator and monomer system. With the preferred azo catalyst from 0.1 to 0.2% by weight of azo catalyst per weight of monomers are used. Using greater amounts of initiator provides no significant advantage.

It is most practical to synthesize the novel oligomers from monomers of type $M_1$, $M_2$ and $M_3$ in a one step polymerization reaction as previously outlined. However, it is also possible, and under certain circumstances necessary, to synthesize the novel oligomers in a two step synthesis. In this alternate synthesis method, hydrolyzable hydrophobic monomers of type $M_3$ are polymerized in the presence of a mercaptan yielding an oligomer containing $[M_3]$ monomer units. In a second step, such oligomers are hydrolyzed with a base, preferably alcoholic sodium or potassium hydroxide solution. In this hydrolysis process, selected $[M_3]$ monomer units are converted into hydrophilic $[M_2]$ monomer units. In this way, vinyl acetate monomer units are converted into vinyl alcohol monomer units or maleate ester units are converted maleic acid salt units. Similarly, an oligomer containing maleic anhydride monomer units can be hydrolyzed or amidized. This two step approach is, however, more costly than the one step synthesis approach step which is preferred and made possible due to the availability of a large number of commercially available hydrophilic monomers of type $M_2$.

The oligomeric thioethers are oxidized to their respective sulfoxides, sulfones or mixtures thereof by treatment with a conventional oxidizing agent such as the inorganic or organic peroxides. Typical inorganic peroxides include hydrogen peroxide, alkali metal peroxides or alkaline earth metal peroxides. Typical organic peroxides include the peroxides of mono-basic carboxylic acids, such as peracetic or perpropionic acid, perbenzoic acid or peroxides of polycarboxylic acids, such as monoperphthalic acid. Hydrogen peroxide is preferred because of its low cost, ready availability, the good results obtainable by its use and because its decomposition product (water) is not deleterious to the reaction. The oxidation of the thioether side chains to the sulfoxide or in sulfone can be effected either with or without diluent. However, when the polyether and peroxide are both solids it is preferred to use as a reaction medium a diluent in which at least one and preferably both reactants are soluble. Examples of such diluents include liquid alcohols, ketones, aromatic hydrocarbons, aliphatic hydrocarbons and the like, with preferred diluents being the lower monohydric alcohols such as methanol, ethanol and isopropanol. The proportion of peroxide to thioether depends upon whether sulfoxide or sulfone side chains are desired. In the preparation of sulfoxide side chains the proportion of peroxide to thioether should be such that at least one atom of oxygen is available for each thioether side chain with the preferred molar ratio of peroxide to thioether side chain being 1.0:1.0 to 1.1:1.0. In preparing sulfone side chains, the ratio of peroxide to thioether side chain is generally 2 to 1, with preferred ratios ranging from 2.0:1.0 to 2.5:1.0. If a mixture of sulfone and sulfoxide side chains are desired, a ratio of peroxide to thioether side chains between the aforementioned ratios is required. The reaction temperature can range from about 0° to about 90° C., with a temperature ranging from about 25° to about 75° C. being preferred. The pressure at which the oxidation reaction takes place is not particularly critical, in that it can be run under atmospheric, sub-atmospheric or superatmospheric conditions.

Further, by selecting the chain length of the R-group and the nature and ratio of the $M_1$, $M_2$ and $M_3$ monomer units it was found that the foam expansion and drainage rate of the protein foam containing the aliphatic sulfide terminated oligomers of the instant invention can be modified. In addition to the abilty of the artisan to use oligomers of the instant invention to modify the foam expansion of aqueous fire fighting foams, the instant compositions can be tailored in such a way as to provide improved extinguishing times with a given aqueous foam concentrate. For most applications of the novel oligomers it was found desirable to achieve a solubility in water or water-solvent mixture of at least 0.01% by weight of oligomer. These very small amounts of oligomers surprisingly have a significant advantageous effect in aqueous fire fighting foams, in terms of foam expansion, foam drainage and fire extinguishing times.

In order to synthesize oligomers of formula I $$R—E—S(O)_n[M_1]_x[M_2]_y[M_3]_z \quad (I)$$

having the most desirable properties as a fire fighting foam additive, it is advantageous to balance the hydrophobic properties of the R—E—S(O)$_n$—segment versus the hydrophilic properties of the $[M_1]$ and $[M_2]$ monomer units and the hydrophobic properties of the $[M_3]$ monomer units in the oligomer. In order to achieve a desired balance of properties it can be advantageous to have more than one type of $[M_2]$ units and more than one type of $[M_3]$ units present in the oligomer. However, it has also been found that in many instances the incorporation of hydrophobic $[M_3]$ monomer units is not necessary at all to achieve the proper balance of hydrophobic versus hydrophilic properties.

As stated before, the novel oligomers are particularly useful as additives to protein foam concentrates used as fire fighting foams. Such concentrates containing the novel oligomers show high foam expansion ratios, and a desirable slow foam drainage rate. As a result such foams control and extinguish difficult to fight fuel fires and form a secure longer lasting foam blanket which suppresses the release of flammable vapors, and has great stability and heat resistance. They further have improved rheology as evidenced by enhanced foam mobility, an important consideration for rapid extinguishment.

Other factors distinguishing superior compositions are the smoothness of the foam blanket and minimal charring characteristics. The subject oligomeric surfactants confer these outstanding properties on protein foam fire extinguishing agents. Such protein foam concentrates can be proportioned (diluted) directly with fresh or sea water and show excellent long-term stability. They can be applied directly to the surface on spill fires.

Protein foams are available commercially as concentrates for either 3% or 6% proportioning. This means that when these concentrates are used the 3% concentrate is mixed with fresh or sea water in a ratio of 3 volumes of concentrate to 97 volumes of water. Similarly, the 6% concentrate is mixed with fresh or sea water in a ratio of 6 volumes of concentrate to 94 volumes of water. Thus the subject oligomers are incorporated in a 6% type concentrate in amounts varying from about 0.1% to about 10%. Similarly, the oligomers are incorporated into a 3% type concentrate in amounts varying from about 0.2% to about 20%. The actual amount depends upon the effects desired.

Aqueous based fire fighting foam concentrates for 1 to 6% proportioning of the present invention advantageously comprise A. between about 0.1 to 10% by weight of an oligomer of formula I, B. between about 0.1 to 60% by weight of fire fighting foam surfactants, fire fighting foam synergist/surfactant mixtures or fire-fighting foam protein hydrolyzates;

C. between 0 to about 70% by weight of thickeners, stabilizers, thixotropes, solvents or mixtures thereof;

D. between 0 to about 10% by weight of electrolytes; and

E. water in an amount sufficient to make up the balance of 100%.

Suitable fire-fighting foam surfactants and fire-fighting foam synergist/surfactant mixtures are well known in the art. Suitable hydrocarbon fire fighting foam surfactants include cationic, anionic, nonionic and amphoteric surfactants, such as those disclosed in U.S. Pat. No. 2,506,032, British Pat. No. 1,052,788, and the like. Suitable fluorochemical fire fighting foam surfactants, and mixtures thereof with hydrocarbon surfactants, or synergists, or protein hydrolyzates, or mixtures thereof, are described for example in U.S. Pat. Nos. 3,315,326, 3,475,333, 3,562,156, 3,655,555, 3,661,776, 3,258,423, 4,090,967, British Pat. Nos. 1,070,289, 1,230,980, 1,245,124, 1,270,662, 1,280,508; Ger. Pat. Nos. 2,136,424, 2,165,057, 2,240,263, 2,315,326, Can. Pat. No. 842,252 and the like.

Suitable fire-fighting foam protein hydrolyzates include, for example, those disclosed in U.S. Pat. Nos. 2,324,951, 2,697,691 and 2,361,057 and the like.

When present, the thickeners, stabilizers, thixotropes, solvents or mixtures thereof, of component C are advantageously present in an amount of between 0.01 to 70%. Suitable thickeners, stabilizers, thixotropes and solvents are those conventional compatable adjuvants known in the aqueous based fire fighting foam art. Exemplary thickeners include polyethylene oxides, carboxymethyl cellulose, polyvinyl alcohol, vinyl methylether/maleic anhydride copolymer and the like. Suitable stabilizers include conventional bacteriostats, such as a halogenated phenol or a bisulfite, viscosity modifiers, foam leveling agents and freeze depressants. The stabilizer may also be a solvent for the concentrate ingredients. Suitable solvents are preferably non-volatile and include those disclosed in U.S. Pat. Nos. 3,457,172, 3,422,011 and 4,090,967. Preferred solvents include alkylene glycols, such as ethylene glycol and hexylene glycol, alkylene glycol monoalkylether, or dialkoxyalkanols, such as 1-butoxyethoxy-2-propanol or diethyleneglycol monobutyl ether and the like.

Suitable thixotropes include conventional polysaccharide materials used in the alcohol resistant aqueous fire fighting foam art.

Suitable electrolytes include alkali metal and alkaline earth metal salts as well as ferric and zinc salts.

As the artisan can appreciate, the optimum selection and amounts of components C and D will vary depending upon the nature of the fire fighting foam surfactant, synergist/surfactant or protein hydrolyzate, component B, chosen.

Preferably, component B is a fire fighting foam protein hydrolyzate, optionally containing a protein hydrolyzate compatable fluorochemical surfactant. More preferably, the component B is a fire fighting foam protein hydrolyzate and the oligomer component A is present in an amount of between about 0.2 and 2% by weight. The amount of protein hydrolyzate in this embodiments is advantageously present in an amount of about 20 to 60% by weight. The concentrate is preferably designed for 3 to 6% proportioning.

Protein fire-fighting foams are described by J. M. Perri ("Fire Fighting Foams" in J. J. Bikerman, ed., Foams; Theory and Industrial Applications, Reinhold Publishing Corp., N.Y. 1953, pp. 189–242; also by N. O. Clark (Spec. Report No. 6, D.S.I.R., H. M. Stationary Ofice, London, 1947). They comprise aqueous fire fighting foams derived from such protein bases as animal proteins, principally keratins, albumins, globulins derived from horns, hoofs, hair, feathers, blood, fishscale, and vegetable proteins from soybean meal, pea flour and maize meal.

In addition such compositions may contain as stabilizers metal salts of variable valency, solvents to impart low temperature performance capability, protective colloids and saponins.

Protein foams were developed as fire-fighting agents for high risk situations involving flammable liquids in bulk, in refineries, tank farms and wherever low flash point fuels, such as gasoline, are stored. The danger that long pre-burns may build up hot zones in deep fuel layers is ever present and under such circumstances standard protein foams, however applied, quickly became contaminated with the fuel, burn themselves off and are therefore limited in their effectiveness.

Such protein hydrolyzate type of fire-fighting foam was made more effective by the addition of fluorinated surfactants, as described in U.S. Pat. No. 3,475,333 and British Pat. No. 1,245,124. These so-called fluoroprotein foam compositions are primarily used as 3% or 6% proportioning concentrates against fires in high risk situations involving bulk storage of flammable liquids. They are widely accepted by major oil and chemical companies as the superior foam extinguishing agent for the oil and petrochemical industry. They also provide optimum foam properties for controlling and extinguishing aircraft crash fires and for general use against hydrocarbon spill fires.

The $R_f$ surfactants in the aforementioned patents are incorporated in order to impart improved properties to protein-type fighting foams by imparting better foam mobility, reduced extinguishing times, and reduce sensitivity to hydrocarbon pickup.

While protein foams containing $R_f$ surfactants as disclosed in the aforementioned patents are certainly beneficial in reducing extinguishing times in fighting hydrocarbon fires if compared with protein foams not containing such surfactants, the $R_f$ surfactants tend to reduce the foam expansion as well as foam drainage time of the protein foam, which are considered to be undesirable side effects because the area which can be covered with a given amount of protein foam concentrate is being reduced and because a faster draining foam shows decreased burnback resistance. In this connection, protein hydrolyzates and the like, containing fluorochemical oligomer surfactants which improve foam expansion, etc., as disclosed copending U.S. application Ser. No. 129,872, filed Mar. 13, 1980, are desirable as component B ingredients.

An alternate embodiment of the invention relates to those concentrates wherein component B is a hydrocarbon surfactant, such as is present in conventional fire fighting syndet foams. Preferably component B is present therein in an amount of between about 0.5 to 20% by weight.

Another alternate embodiment relates to aqueous film-forming foam concentrates, or so called AFFF agents wherein component B is either a fluorochemical surfactant, a mixture of fluorochemical surfactant and hydrocarbon surfactant, or a mixture of fluorochemical surfactant, hydrocarbon surfactant and fluorochemical synergist. In this embodiment, the total amount of fluorochemical surfactant is preferably between about 0.1 and 3% by weight, the amount of hydrocarbon surfactant, when present, between 0.001 and 20% by weight, and the amount of fluorochemical synergists, when present, between about 0.005 and 1% by weight.

AFFF (Aqueous Film Forming Foam) agents, as mentioned above, are comprised of mixtures of fluorochemical and optionally non-fluorochemical surfactants, solvents, etc., and generally perform better than protein foams on fuel spill fires. The non-fluorochemical surfactants are generally chosen on the basis of toxicity, biodegradability, corrosivity, stability, foamability, fire performance, and cost. Improvement or retention of foamability is a highly desirable quality for a new candidate surfactant.

One convenient technique for preparing fire fighting foam concentrates for 1 to 6% proportioning involves the simple incorporation of an oligomer of formula I in a commercially available fire fighting foam concentrates for said proportioning in an amount effective to improve foam expansion, foam drainage and fire extinguishing rate, preferably in an amount of about 0.1% to 10% of oligomer of formula I, by weight, based on said concentrate.

The stabilizers of formula I are useful in improving the foam characteristics, such as increased foam expansion, slower foam drainage and consequently better extinguishing times in diverse aqueous based fire fighting foam compositions, including aqueous syndet foams, such as the so-called medium expansion and high expansion foams; AFFF agents, also known as Aqueous Film Forming Foams; protein foams, fluoroprotein foams, and all purpose alcohol resistant foams.

Preferred conventional syndet foams for use in conjunction with the instant invention are those foams containing a hydrocarbon surfactant, which may be anionic, cationic, amphoteric or nonionic or compatible mixtures thereof, optionally a thickener, such as polyethylene oxide, polyvinyl alcohol, carboxymethylcellulose, and the like, and optionally a solvent, such as a lower alkanol, lower alkoxyalkanol, and the like and water. Ordinarily such syndet fire fighting agents are in the form of a 6 percent, 3 percent or 1 percent concentrate.

By a 6 percent concentrate is meant a concentrate which is diluted in the proportion of 6 parts concentrate to 94 parts water. A 3 percent concentrate is thus one in which 3 parts of concentrate are diluted with 97 parts water, and a 1 percent concentrate is one which is diluted for use with 1 part concentrate to 99 parts water.

Preferred conventional AFFF foams are those which contain a fluorochemical surfactant, which may be cationic, anionic, amphoteric, nonionic or mixtures thereof; optionally a fluorochemical synergist; optionally a compatible hydrocarbon surfactant, which may be cationic, anionic, amphoteric, nonionic or a compatible mixture thereof; optionally a thickener, such as a polyethylene oxide, polyvinyl alcohol, carboxymethyl cellulose; optionally a thixotropic agent, such as a polysaccharide; optionally a solvent such as a lower alkanol or alkoxyalkanol; optionally alkali or alkaline with metal salt, such as magnesium sulfate; and water.

Ordinarily AFFF agents are in the form of 6 percent, 3 percent or 1 percent concentrates.

Preferred conventional protein foams are those aqueous based foams containing a protein hydrolysate, stabilizers comprised of metal salts of variable valency, solvents to impart low temperature performance capability, and optionally protective colloids and saponins.

The instant invention also relates to use dilutions of the foam concentrates containing a stabilizer of formula I. These use dilutions are advantageously prepared by diluting the stabilizer containing 1 to 6% concentrates of the present invention with water in a range of between about 99 parts by volume water to 1 part by volume concentrate and about 94 parts by volume water to 6 part by volume concentrate, respectively.

The instant invention also relates to a method of extinguishing a fire with an aqueous based foam of the instant invention, obtained by generating a foam of the use dilution of the instant invention and applying the foam to a fire in an amount sufficient to extinguish the same.

EXAMPLES

The following is a list of examples to illustrate the preparation and the usefulness of the oligomers of this invention. The examples are for illustrative purposes only and are not to be construed as limiting in any fashion.

Examples 1 to 47 illustrate the methods of preparation of the instant oligomers and show how they can be used to modify the foam expansion ratio and drainage rate of protein foams and AFFF compositions.

The preparation of the oligomers is straightforward and reaction occurs readily in the absence of air or oxygen as evidenced by the appearance of solid which precipitates within a few minutes in many cases. Oligomers can be characterized directly using HPLC (high pressure liquid chromatography) techniques. Product formation is confirmed also by complete disappearance of mercaptan determined by iodine test and almost complete consumption of monomer. Oligomers are characterized by their water solubility, aqueous surface tension reduction capabilities, and their effect upon protein and AFFF foam characteristics.

The structures indicated for the oligomer showing single values for x, y, and z is idealized. Such products are composed of a distribution of compositions centered about the single value of x+y+z.

EXPERIMENTAL

Foam expansion data on the various oligomers were determined in 3 or 6% Protein Concentrations of either of three commercial types designated Type A, B, or C according to their source Such data is only reproducible within a given series due to the inconsistency of laboratory scale foaming devices. Consequently, data is usually reported for examples with additives relative to the unadulterated protein itself.

Surface tension and interfacial tension were run at 0.1% oligomer actives in distilled water.

EXAMPLES 1–28

$$C_xH_{2x+1}S[CH_2\underset{\underset{CONH_2}{|}}{C}H]_m-H$$

To 8 oz. glass bottles were added $C_xH_{2x+1}SH$ (x=8, 10, 12, 14, 16 and 18), acrylamide (n=5, 10, 15, 20 and 50) isopropyl alcohol at 10% solids dilution and 2,2'-azobis-(2,4-dimethylvaleronitrile) (0.2% of acrylamide charge). The bottles were purged with nitrogen, sealed and placed in an 80° C. oil bath with magnetic stirring for about 18 hours. The starting material was a clear solution and the final product was a white precipitate. The contents of the bottles were dried in a draft oven at 60° C. for 24 hours. The resulting products were white dusty powders obtained in quantitative yields.

In Table 1 are given the experimental data for preparation of these various oligomers, their surface properties, and this effect on protein foam expansion.

TABLE 1

| | | | Dynes/cm (at 0.1%) | | | |
|---|---|---|---|---|---|---|
| | | | Surface | Interfacial | Foam Expansion | |
| Example | x | n | Tension | Tension | 3T | 3S |
| 1 | 8 | 5 | 31.4 | 7.8 | 3.9 | — |
| 2 | 9 | 10 | 34.7 | 10.5 | 4.5 | — |
| 3 | 8 | 15 | 41.6 | 15.1 | 5.4 | 5.2 |
| 4 | 8 | 20 | 47.0 | 18.0 | 5.6 | 5.2 |
| 5 | 10 | 5 | 30.4 | 11.9 | — | — |
| 6 | 10 | 10 | 32.6 | 4.0 | 8.5 | — |
| 7 | 10 | 20 | 32.7 | 4.8 | 7.8 | — |
| 8 | 10 | 50 | 35.1 | 4.8 | 8.0 | — |
| 9 | 12 | 5 | 33.1 | 4.5 | 4.3 | — |
| 10 | 12 | 10 | 33.7 | 5.7 | 3.8 | — |
| 11 | 12 | 15 | 36.2 | 6.7 | 6.6 | 6.8 |
| 12 | 12 | 20 | 34.3 | 6.8 | 6.8 | 7.0 |
| 13 | 12 | 50 | — | — | — | — |
| 14 | 14 | 15 | — | — | 8.5 | 9.1 |
| 15 | 14 | 20 | — | — | 8.8 | 9.8 |
| 16 | 14 | 30 | — | — | 8.8 | 10.1 |
| 17 | 14 | 40 | — | — | 9.3 | 10.2 |
| 18 | 14 | 50 | — | — | 9.6 | 9.2 |
| 19 | 16 | 5 | 34.9 | 6.5 | 3.3 | — |
| 20 | 16 | 10 | 35.2 | 6.2 | 4.9 | — |
| 21 | 16 | 15 | 34.5 | 7.0 | 5.1 | — |
| 22 | 16 | 20 | 38.8 | 7.4 | 5.0 | — |
| 23 | 16 | 50 | 40.7 | 9.6 | 6.0 | — |
| 24 | 18 | 5 | 46.2 | 11.1 | 4.8 | — |
| 25 | 18 | 10 | 39.7 | 12.8 | 5.3 | — |
| 26 | 18 | 15 | 41.8 | 11.7 | 5.2 | — |
| 27 | 18 | 20 | 44.7 | 10.2 | 5.6 | — |
| 28 | 18 | 50 | 45.1 | 15.3 | 5.9 | — |
| Control (none) | | | | | 5.2 | 5.7 |

[1]At 1.5% actives in 3% Protein Type 3 and run as a 3% dilution in tap water or synthetic sea water.

EXAMPLE 29

$$C_{14}H_{29}S(CH_2\underset{\underset{CONH_2}{|}}{C}H)_{25}H$$

To a 3-liter stainless steel 3-neck round bottom flask equipped with a stirrer nitrogen inlet and a reflux condenser, were added 23 g (0.10 mole) of n-tetradecyl mercaptan, 177.3 g (2.5 mole) of acrylamide and 782.0 g of isopropanol. A mechanical syringe pump was charged with 18 ml of a solution of 1% 2,2'-azobis-(2,4-dimethylvaleronitrile) in 99% isopropanol and while the reaction was maintained at 70° C. with nitrogen atmosphere the solution was infused over a period of 3 hours. The resulting product was adjusted to 23% solids, 37% isopropanol and 40% $H_2O$ to obtain a clear solution. Table 2 lists laboratory foam expansion and quarter drain times for solutions of 90% of 3% Protein Concentrate C and 0, 1, 1.5 and 2.0% actives of Example 29. Table 3 are the actual fire tests results for Example 29 in general accordance with Federal Specification OG-555C for protein foam liquid fire extinguishing agents. These actual fire tests were conducted with hexane rather than heptane but were otherwise in accord with the OF-555C procedure described.

TABLE 2

| | 3% Protein Type C | % Water | % Actives | Foam Expansion | (Quarter Drain Time) at 3% Tap Dilution |
|---|---|---|---|---|---|
| 1 | 90.0 | 10.0 | 0.0 | 4.4 | (180 sec) |
| 2 | 90.0 | 9.0 | 1.0 | 6.8 | (250 sec) |
| 3 | 90.0 | 8.5 | 1.5 | 7.1 | (258 sec) |
| 4 | 90.0 | 8.0 | 2.0 | 7.3 | (232 sec) |

TABLE 3

| Test | Fuel | Protein* | Additive | % Actives | Control | Extinguishment | Expansion | Quarter Drain Time |
|---|---|---|---|---|---|---|---|---|
| 1 | Hexane | 3% | None | — | 3:00 | 4:15 | 6.9 | 5:30 |
| 2 | Hexane | 3% | Ex. 29 | 1.5 | 2:10 | 4:30 | 7.7 | 6:30 |

*Protein Type C

OF-555C PROCEDURE

A 6-gallon per minute mechanical foam nozzle supplied with synthetic sea water at line pressure of 100 pounds p.s.i.g. at about 20° C. is used. The foam concentrate at about the same temperature is inducted at the appropriate proportioning rate (3% cncentration by volume). The tank used for the fire test is made of steel measuring 10-feet square by 3-feet deep. The nozzle is positioned in the middle of the windward side of the tank with the nozzle 16 inches above the top edge of the tank. A minimum of 75 gallons of fuel (hexane was used)

is floated on a quantity of water sufficient to bring the fuel surface to 2 feet below the tank edge. The wind velocity should be below 10 mils per hour. The fire is allowed to burn freely for 60 seconds before foam application. The foam stream is directed across the fire to strike the opposite edge of the pan 12 inches above the fuel level and is applied for five minutes continuously. The period of time after the start of application as required for the foam to spread over the tank (coverage), for the fire to be extinguished except for lack of flame (control) and for the fire to go out completely (extinguishment) are reported.

EXAMPLES 30–33

$$C_{12}H_{25}S-[CH_2\underset{\underset{CONH_2}{|}}{C}H-]_nH,$$

wherein n=15, 20, 25, 30

To a 2-liter reactor were charged 170.0 grams of isopropyl alcohol and then simultaneously two reactor streams, one containing x grams of acrylamide and y grams of dodecyl mercaptan in 700 grams of isopropyl alcohol and the other containing approximately 0.4 gram of 2,2'-azobis-(2,4-dimethylvaleronitrile) catalyst in 40 grams of isopropyl alcohol. The reactants and catalyst are added to the reactor (maintained at 80° C.) over periods of 2 hours and 5 hours respectively, resulting in a continuous formation of telomeric product while permitting safe control of the exothermic oligomerization. At the end of the catalyst addition the reaction is terminated and the product collected by filtration and adjusted with water to about 30% solids. Table 4 lists the molar ratios of acrylamide:dodecyl mercaptan and the x and y (above) values for each Example (30–33). Table 5 lists the foam expansion and quarter drain times of Examples 30–33 at 1.5% actives in 3% Protein Conc. A. Table 6 lists the foam expansion and quarter drain times of Example 31 at varying % actives in 3% Protein Type A and 3% Protein Type B. Table 7 shows the results of a more precise study comparing the $$C_{12}H_{25}S-[CH_2\underset{\underset{CONH_2}{|}}{C}H]_{20}H$$

oligomer and the $$C_{12}H_{25}S-[CH_2\underset{\underset{CONH_2}{|}}{C}H-]_{30}H$$

oligomer at 1.5% actives in 3% protein Type A at 3% tap water dilution.

TABLE 4

| Example | n Acrylamide/$C_{12}$-Mercaptan | x Acrylamide (grams) | y $C_{12}$-Mercaptan (grams) |
|---|---|---|---|
| 30 | 15/1 | 202 | 38 |
| 31 | 20/1 | 210 | 30 |
| 32 | 25/1 | 216 | 24 |
| 33 | 30/1 | 220 | 20 |

TABLE 5

| | Foam Expansion in Protein Type A | | |
|---|---|---|---|
| Example | n | Foam Expansion | Quarter Drain Time |
| 30 | 15 | 8.3 | 175 |
| 31 | 20 | 8.0 | 153 |
| 32 | 25 | 7.9 | 210 |
| 33 | 30 | 8.2 | 246 |
| Control | — | 7.5 | 180 |

TABLE 6

| | Protein Concentrates A and B (3% Type) | | | | |
|---|---|---|---|---|---|
| | | Concentrate A | | Concentrate B | |
| Example 31 Additive | % Actives | Foam Expansion | Quarter Drain Time | Foam Expansion | Quarter Drain Time |
| | 1.5 | 7.2 | 134 | 8.8 | 133 |
| | 1.25 | 7.5 | 146 | 9.1 | 192 |
| | 1.0 | 7.25 | 122 | 8.6 | 182 |
| | 0.75 | 7.25 | 125 | 8.6 | 170 |
| | .20 | 6.8 | 121 | 7.8 | 182 |

TABLE 7

| | Foam Expansions | | | |
|---|---|---|---|---|
| | Foam | (Drain) | Foam | (Drain) |
| | Example 31 | | Example 33 | |
| Run 1 | 8.9 | (295) | 8.6 | (337) |
| 2 | 8.9 | (293) | 8.5 | (344) |
| 3 | 9.0 | (301) | 8.7 | (331) |

EXAMPLES 34–42

To 8 oz. bottles were added $C_{12}H_{15}SH$, one or more comonomers in the amounts and mol ratios set forth in Table 8, isopropanol to afford a 20% solids dilution, and 2,2'-azobis-(2,4-dimethylvaleronitrile) (2% by wt. of monomers). The bottles were purged with nitrogen, sealed and heated at 80° C. with stirring for 18 hours. An aliquot of each telomer and cotelomer was dried for solids, and elemental analysis surface tension measurements were made on the homogeneous 20% solutions (warmed as necessary).

Table 8 describes the composition of Examples 34–42, product yields, the surface tension of 0.1% solutions in distilled water, and foam expansion properties of protein foam type with/without 1.5% of the oligomeric examples. Table 9 tabulates the elemental analyses for Examples 34–42. In most cases a substantial foam expansion improvement was noted. No obvious correlation exists between the measured surface tensions and foam expansion properties.

TABLE 8

| | $C_{12}H_{25}SH$ Oligomers | | | | |
|---|---|---|---|---|---|
| Example | Comonomers | Mol (Ratios) | Yield (%) | Foam Expansion | Surface Tension |
| 34 | Acrylamide | 15 | 99 | 6.7 | 35.4 |
| | t-Butyl Acrylamide | 2 | | | |
| 35 | t-Octyl Acrylamide | 20 | 103 | 9.4 | insol. |

TABLE 8-continued

| Example | Comonomers | Mol (Ratios) | Yield (%) | Foam Expansion | Surface Tension |
|---|---|---|---|---|---|
| | $C_{12}H_{25}SH$ Oligomers | | | | |
| 36 | t-Butyl Acrylamide | 20 | 106 | 12.3 | insol. |
| 37 | Acrylamide | 19 | 99 | 7.3 | 32.3 |
| | t-Butyl Acrylamide | 1 | | | |
| 38 | Acrylamide | 19 | 98 | 11.2 | 30.9 |
| | t-Octyl Acrylamide | 1 | | | |
| 39 | Acrylamide | 19.5 | 98 | 18.2 | 34.1 |
| | Acrylic Acid | 0.5 | | | |
| 40 | Acrylamide | 19.5 | 98 | 9.1 | 34.0 |
| | Diacetone Acrylamide | 0.5 | | | |
| 41 | Acrylamide | 19.5 | 99 | 8.0 | 33.2 |
| | Ethyl Acrylate | 0.5 | | | |
| 42 | Acrylamide | 20.0 | 99 | 17.5 | 35.7 |
| Control | None | | | 7–8 | — |

[a]Relative foam expansion at 3% dilution from a commercial 3% Protein Foam Concentrate Type - containing 1.5% oligomer actives.

TABLE 9

| Examples | | % C | % H | % N | % S |
|---|---|---|---|---|---|
| 34 | Found | 51.6 | 7.9 | 14.4 | 2.0 |
| | Calculated | 56.0 | 8.4 | 15.6 | 2.1 |
| 35 | Found | 71.1 | 11.5 | 6.9 | 0.8 |
| | Calculated | 72.2 | 11.6 | 7.3 | 0.8 |
| 36 | Found | 63.3 | 10.2 | 9.1 | 1.1 |
| | Calculated | 66.5 | 10.5 | 10.2 | 1.2 |
| 37 | Found | 50.3 | 7.5 | 15.4 | 1.7 |
| | Calculated | 54.3 | 8.0 | 16.7 | 2.0 |
| 38 | Found | 51.4 | 7.3 | 15.0 | 1.7 |
| | Calculated | 55.3 | 8.2 | 16.1 | 1.8 |
| 39 | Found | 50.0 | 7.6 | 15.2 | 2.0 |
| | Calculated | 53.2 | 7.8 | 16.8 | 2.0 |
| 40 | Found | 49.7 | 7.6 | 15.4 | 1.8 |
| | Calculated | 53.5 | 7.9 | 16.7 | 1.9 |
| 41 | Found | 49.9 | 7.8 | 15.2 | 1.9 |
| | Calculated | 53.5 | 7.9 | 16.7 | 2.0 |
| 42 | Found | 48.9 | 7.4 | 15.5 | 2.0 |
| | Calculated | 53.2 | 7.8 | 17.3 | 2.0 |

EXAMPLE 43

This example illustrates a novel preparative procedure for the subject oligomers which results in high solids, non-flammable product. The oligomer Example 42 composition is described but the process is amenable to the other compositions cited.

A holding flask is charged with acrylamide (1.23 moles, 87.5 parts), dodecyl mercaptan (0.062 moles, 12.5 parts), (200 parts), and stirred with gentle warming until clear.

The main reaction vesel is equipped with stirrer, heater and thermometer and is equipped for distillation. It is charged with ethylene glycol (100 parts) and azo catalyst (Note 1) (0.5 parts), and then heated to 85° while stirring and with a nitrogen sweep.

After a few moments, the contents of the holding flask are delivered slowly to the main reaction vessel (90 minutes total) while additional catalyst (50 parts of 1% azo catalyst is methanol) is infused (210 minutes total). Both the contents of the holding flask and additional catalyst are simultaneously added to the main reactor while methanol is distilled off and collected. The reactor maintains a 73°–76° temperature until completion of the solvent transferr at which time the temperature climbs back to 85°. Completeness of the reaction is determined by a negative test for —SH with dilute iodine.

Finally butyl carbitol (40 parts) and water (60 parts) are charged to the reaction vessel resulting in 300 parts with the following composition:

33.3% actives
33.3% ethylene glycol
13.3% butyl carbitol
20.0% water

The product can be assayed for % N and % S to determine actives.

Notes:

1. 2,2'-azobis (2-amidinopropane)hydrochloride can be used for this process. Any azo compound with suitable half-life and solubility in ethylene glycol is suitable.

2. 250 parts of reusable methanol are recovered which contains-1% mercaptan contaminant.

EXAMPLES 44–45

These examples demonstrate that sulfoxide and sulfone type oligomeric compositions also have utility to improve protein foam expansion.

$C_{12}H_{25}SO[CH_2CONH_2]_{30}H$ 50 g (0.008 moles) of a 35% solution of $C_{12}H_{25}S[CH_2CHCONH_2]_{30}H$ in isopropanol/water was reacted with 1.3 g (0.010 moles) 30% hydrogen peroxide at 45° for 2 hours. The resulting solution showed a strong sulfoxide absorption at 9.7 microms (AgCl plates).

$C_{12}H_{25}SO_2[CH_2CHCONH_2]_{30}H$ 17.8 g (0.008 moles) of $C_{12}H_{25}S[CH_2CHCONH_2]_{30}H$ was reacted with 2.6 g (0.02 moles) 30% hydrogen peroxide, and 40 g. acetic acid at 100° for 4 hours. The acetic acid was removed under vacuum leaving 16.1 g solids still showing residual weak sulfoxide absorption at 9.7 microns.

Table 10 describes the results obtained when 1.5% percent of the sulfoxide and sulfone oligomers described in Examples 44 and 45 were used in protein. Whereas the foam expansion was essentially unchanged the QDT improved and the surface tension at 3% dilution in tap water was virtually unaffected.

TABLE 10

| Example' | % Actives | Sulfoxide and Sulfone Oligomers Foam Expansion | Quarter Drain Time | at 3% (Tap) |
|---|---|---|---|---|
| — | 1.5 | 5.6 | 408 | 38.9 |
| — | 1.5 | 5.7 | 408 | 35.1 |
| Control | — | 5.7 | 366 | 37.7 |

All dilutions remained clear
'Type A Protein Concentrate

EXAMPLE 46

This example shows that these oligomeric surfactants are useful in fully formulated AFFF compositions as additives to maintan high foam expansion and slow drainage characteristics in both tap and sea water dilutions. Other surfactants frequently adversely affect these properties.

| AFFF Agent | Foam Expansion | Quarter Drain Time (sec) |
|---|---|---|
| | Tap/Sea | Tap/Sea |
| Alone | 6.3–6.5 | 220 |
| With Ex. 30 | essentially unchanged | |

EXAMPLE 47

The oligomeric surfactant of Examples 33 was successfully incorporated into an AFFF composition and used to extinguish a 50 $ft^2$ fire. The 6% proportioning composition contained:

1. Oligomeric stabilizer of Example 33—0.7%.
2. Fluorochemical surfactant and synergist, as described in U.S. Pat. No. 4,090,967 consisting of $R_fCH_2CH_2SCH_2CH_2CONHC(CH_3)_2CH_2SO_3Na$ wherein $R_f$ is a mixture of $C_6F_{13}$, $C_8F_{17}$, and $C_{10}F_{21}$ and $R_fCH_2CH_2SCH_2CH_2CONH_2$ wherein $R_f$ is a mixture of $C_6F_{13}$ and $C_8F_{17}$—1.3%.
3. Partial sodium salt of N-lauryl beta iminodiproprionic acid—0.6%.
4. Octylphenoxypolyethylenoxyethanol—0.6%.
5. Magnesium sulfate—0.3%.
6. Butoxyethoxyethanol—18.0%.
7. Water—remainder.

This formulation was successfully used to extinguish a 50 $ft^2$ fire per MIL F-24385B when diluted by 16 parts of sea water.

Comulative 40 sec. summation—313
Burnback time—6.5 minutes
Expansion—8.0
25% Drain time—280 seconds.

In the above Examples, the protein foam concentrates are all 3% concentrates, commercially available from Angus Fire Armour Ltd. (Type A), National Foam Systems Inc. (Type B), and Lorcon Foam, Inc. (Type C).

What is claimed is:

1. An aqueous based fire fighting foam concentrate for 1 to 6% by volume proportioning, comprising A. between about 0.1 and 10% by weight of an oligomer of the formula $$R_1\text{-}E\text{-}S(O)_n[M_1]_x[M_2]_y[M_3]_zH \quad (I)$$

wherein $R_1$ is an oleophilic aryl, araliphatic, aliphatic or cycloaliphatic group selected from the group consisting of: phenyl or naphthyl each of which are unsubstituted or substituted by alkyl of up to 18 carbon atoms, alkoxy of up to 18 carbon atoms, chloro, bromo, alkanoyl of up to 18 carbon atoms, alkanoyloxy of up to 18 carbon atoms, or alkanoylamino of up to 18 carbon atoms;

alkyl or alkenyl of up to 12 carbon atoms, each of which is substituted by phenyl or naphthyl which is, in turn, unsubstituted or substituted by alkyl of up to 18 carbon atoms, alkoxy of up to 18 carbon atoms, chloro, bromo, alkanoyl of up to 18 carbon atoms, alkanoyloxy of up to 18 carbon atoms, or alkanoylamino of up to 18 carbon atoms;

alkyl or alkenyl of up to 25 carbon atoms, each of which are unsubstituted or substituted by hydroxy, alkoxy of up to 18 carbon atoms, chloro, bromo, alkanoyl of up to 18 carbon atoms, alkanoyloxy of up to 18 carbon atoms or alkanoylamino of up to 18 carbon atoms; and cycloalkyl of 5 to 7 carbon atoms, bicycloalkyl of 7 to 10 carbon atoms, cycloalkylalkylene of 6 to 12 carbon atoms or bicycloalkyl alkylene of 8 to 14 carbon atoms, each of which are unsubstituted or substituted by alkyl of up to 18 carbon atoms, alkoxy of up to 18 carbon atoms, chloro, bromo, alkanoyl of up to 18 carbon atoms, alkanoyloxy of up to 18 carbon atoms or alkanoylamino of up to 18 carbon atoms;

E is a direct bond or an organic covalently bonded linking group;

n is 0, 1 or 2;

$[M_1]$ is a hydrophilic optionally substituted acrylamido monomer unit;

$[M_2]$ is a copolymerizable non-acrylamido hydrophilic monomer unit;

$[M_3]$ is a copolymerizable hydrophobic monomer unit; wherein the acrylamido monomer units, $[M_1]$, are within the scope of the formula

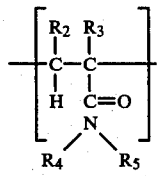

(II)

wherein $R_2$ and $R_3$ are independently hydrogen, chloro or bromo, or one of $R_2$ and $R_3$ is alkyl of 1 to 4 carbon atoms, alkoxy of 1 to 4 carbon atoms or alkanoylamido of 2 to 4 carbon atoms and the other is hydrogen;

and each of $R_4$ and $R_5$ independently represent hydrogen, alkyl of 1 to 18 carbon atoms which is unsubstituted or substituted by hydroxy, alkoxy of 1 to 4 carbon atoms, alkanoyl of 1 to 4 carbon atoms; alkanoyloxy of 1 to 4 carbon atoms; alkanoylamino of 1 to 4 carbon atoms; cyano; carboxy; ureido; alkylureido or dialkylureido wherein the alkyl group in each case contains 1 to 4 carbon atoms; amido; N-alkylamido or N,N-dialkylamido wherein the alkyl group in each case contains 1 to 4 carbon atoms; allyloxy; bromo; chloro; amino; N-alkylamino, N,N-dialkylamino or N,N,N-trialkylamino halide wherein the alkyl group in each case contains 1 to 4 carbon atoms; N-carboxyalkylamino, N-(carboxyalkyl)-N-alkylamino or N-(carboxyalkyl)-N,N-dialkylamino wherein the alkyl group in each case contains 1 to 4 carbon atoms; mercapto; alkylthio of 1 to 4 carbon atoms; morpholino; phenyl; or tolyl or is phenyl or phenyl substituted by carboxy, chloro, nitro, sulfo, alkyl of 1 to 4 carbon atoms or alkoxy of 1 to 4 carbon atoms; or is allyl, amino, naphthyl, cycloalkyl of 6 to 12 carbon atoms, phenylamino, N-alkylamino, N,N-dialkylamino or N,N,N-trialkylamino halide where in each case the alkyl group has 1 to 4 carbon atoms; or $R_4$ and $R_5$ taken together with the nitrogen to which they are attached represent morpholino, aziridino, piperidino or pyrrolidino;

with the proviso that the sum total of carbon atoms in $R_2$, $R_3$, $R_4$ and $R_5$ together contain no more than 10 carbon toms;

the copolymerizable non-acrylamido hydrophilic monomer units, $[M_2]$, are those of the formula

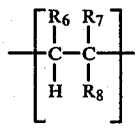

(III)

wherein $R_6$ is hydrogen, carboxy, —$COOR_9$ or alkyl of 1 to 4 carbon atoms which is unsubstituted or substituted by carboxy or hydroxy;

$R_7$ is hydrogen or alkyl of 1 to 4 carbon atoms; and $R_8$ is carboxy, carboxyalkyl of 2 to 5 carbon atoms, carboxyphenyl, a 5 to 6 membered nitrogeneous heterocyclic moiety, hydroxyalkyl of 1 to 4 carbon atoms, sulfophenyl, sulfo, —$COOR_9$, —$SO_2NR_{10}R_{10}$, —$NHCOR_9$, —$COR_9$, —$SO_2R_9$, —$OR_{10}$, —$OCOR_9$ or

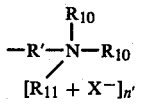

wherein $R_9$ is alkyl of 2 to 6 carbon atoms substituted by sulfo, carboxy, hydroxy, methoxy, or $R_{12}(OCH_2CH_2)_mO$— where $R_{12}$ is hydrogen or alkyl of 1 to 4 carbon atoms and m is 1 to 20;

$R_{10}$ is hydrogen, or lower alkyl of 1 to 5 carbon atoms which is substituted by sulfo, carboxy, hydroxy, methoxy or $R_{12}(OCH_2CH_2)_mO$— where $R_{12}$ and m are as defined above;

R′ is a direct bond, alkylene of 1 to 6 carbon atoms or phenylene;

$R_{11}$ is lower alkyl of 1 to 4 carbon atoms, phenyl or benzyl;

X is halo; and n′ is 0 or 1, and the hydrophobic copolymerizable monomer units, $[M_3]$, are those of formula II above wherein the sum total of carbon toms in $R_2$, $R_3$, $R_4$ and $R_5$ together contain a total of more than 10 carbon atoms or are of the formula IV

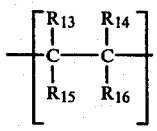

(IV)

wherein $R_{13}$ and $R_{14}$ are independently hydrogen, chloro, bromo, fluoro, or alkyl of 1 to 4 carbon atoms; $R_{15}$ is hydrogen, chloro, bromo, fluoro, alkyl of 1 to 8 carbon toms, or —$COOR_{17}$; and $R_{16}$ is hydrogen, chloro, bromo, fluoro, alkenyl of 2 to 18 carbon atoms, alkyl of 1 to 18 carbon atoms, cyano, phenyl, phenyl substituted by alkyl of 1 to 4 carbon atoms or chloro, —$COOR_{17}$, —$SO_2NR_1R_{17}$ —$NHCOR_{17}$, —$COR_{17}$, —$SO_2R_{17}$, —$OR_{17}$ or —$OCOR_{17}$ wherein $R_{17}$ is alkyl of 1 to 18 carbon atoms which is unsubstituted or substituted by chloro, bromo or phenyl, or alkenyl of 2 to 18 carbon atoms which is unsubstituted or substituted by chloro, bromo or phenyl;

the average of the sum of x, y and z is between about 3 and about 500; and x/x+y+z is between 1 and about 0.5;

B. between about 0.1 to 60% by weight of fire fighting foam surfactants, fire fighting foam synergist/surfactant mixtures or fire-fighting foam protein hydrolyzates or mixtures thereof;

C. between 0 to about 70% by weight of thickeners, stabilizers, thixotropes, solvents or mixtures thereof;

D. between 0 to about 10% by weight of electrolytes; and

E. water in an amount sufficient to make up the balance of 100%.

2. An aqueous based fire fighting foam concentrate according to claim 1, wherein $R_1$ is straight or branched chain alkyl of 5 to 25 carbon atoms.

3. An aqueous based fire fighting foam concentrate according to claim 2, wherein $R_1$ is straight or branched chain alkyl of 6 to 18 carbon atoms and E is a direct bond.

4. An aqueous based fire fighting foam concentrate according to claim 1, wherein $[M_1]$ is that of formula II where $R_2$ is hydrogen, $R_3$ is hydrogen or methyl, $R_4$ is hydrogen and $R_5$ is hydrogen or methyl, $R_4$ is hydrogen and $R_5$ is hydrogen or alkyl of up to 8 carbon atoms which is straight or branched chain, and is unsubstituted or substituted by hydroxy or acetyl, or mixtures thereof, $[M_2]$ is that of formula III wherein $R_6$ is hydrogen, carboxy or —$COOR_9$ wherein $R_9$ is alkylene of 2 to 4 carbon atoms substituted by hydroxy or $R_{12}(OCH_2CH_2)_mO$— where $R_{12}$ is hydrogen, methyl or ethyl and m is 1 to 10; $R_7$ is hydrogen; and $R_8$ is carboxy; hydroxy; methoxy; alkoxy of 2 to 4 carbon atoms substituted by hydroxy or $R_{12}(OCH_2CH_2)_mO$— where $R_{12}$ is hydrogen, methyl or ethyl and m is 1 to 10; or —$COOR_9$ where $R_9$ is alkylene of 2 to 4 carbon atoms substituted by hydroxy or $R_{12}(OCH_2CH_2)_mO$— wherein $R_{12}$ is hydrogen, methyl or ethyl and m is 1 to 10, or mixtures thereof, and

[$M_3$] is that of formula IV wherein $R_{13}$ and $R_{14}$ are hydrogen, $R_{15}$ is hydrogen or —$COOR_{17}$ and $R_{16}$ is hydrogen, cyano, phenyl, —$OR_{17}$, —$COOR_{17}$ or —$OCOR_{17}$ where $R_{17}$ is alkyl of 1 to 6 carbon atoms.

5. An aqueous based fire fighting foam concentrate according to claim 4, wherein [$M_1$] is that of formula II wherein $R_2$ is hydrogen, $R_3$ is hydrogen, $R_4$ is hydrogen and $R_5$ is hydrogen or straight or branched chain alkyl of up to 4 carbon atoms.

6. An aqueous based fire fighting foam concentrate according to claim 5, wherein [$M_1$] is that of formula II wherein $R_2$, $R_3$, $R_4$ and $R_5$ is hydrogen.

7. An aqueous based fire fighting foam concentrate according to claim 6, wherein y and z are each zero.

8. An aqueous based fire fighting foam concentrate according to claim 7, wherein x is between about 3 and 50.

9. An aqueous based fire fighting foam concentrate according to claim 1, wherein component B is a fire fighting foam protein hydrolyzate.

10. An aqueous based fire fighting foam concentrate according to claim 1, wherein component B is a fire fighting foam protein hydrolyzate, containing a protein hydrolyzate compatable fluorochemical surfactant.

11. An aqueous based fire fighting foam concentrate according to claim 9, wherein the protein hydrolyzate component B is present in an amount of about 20 to 60% by weight and the oligomer component A is present in an amount between about 0.2 and 2% by weight.

12. An aqueous based fire fighting foam concentrate according to claim 11, designed for 3 to 6% by volume proportioning with water.

13. An aqueous based fire fighting foam concentrate according to claim 1, wherein component B is a hydrocarbon surfactant in an amount of between about 0.5 and 20% by weight.

14. An aqueous based fire fighting foam concentrate according to claim 1, which is an aqueous film-forming foam concentrate wherein component B is either a fluorochemical surfactant, a mixture of fluorochemical surfactant and hydrocarbon surfactant or a mixture of fluorochemical surfactant, hydrocarbon surfactant and fluorochemical synergist.

15. A fire fighting aqueous use dilution composition of the concentrate composition of claim 1, diluted with water in a range of between about 99 parts by volume water to 1 part by volume concentrate and about 94 parts by volume water to 6 parts by volume concentrate.

16. A method of extinguishing a fire comprising generating a foam of the use dilution composition of claim 15 and applying said foam to the fire in an amount sufficient to extinguish the same.

17. In an aqueous fire fighting foam concentrate for 1 to 6% proportioning, the improvement comprising the incorporation of an oligomer as defined in claim 1 into an aqueous fire fighting foam concentrate in an amount effective to improve foam expansion, foam drainage and fire extinguishing rate.

18. A composition according to claim 17, wherein said aqueous fire fighting foam concentrate is an aqueous protein foam concentrate.

19. A composition according to claim 17, wherein said aqueous fire fighting foam concentrate in an aqueous fluoroprotein foam concentrate.

20. A composition according to claim 17, wherein said aqueous fire fighting foam concentrate is an aqueous film forming foam concentrate.

21. A composition according to claim 17, wherein said aqueous fire fighting foam concentrate is an aqueous syndet foam concentrate.

* * * * *